US005318231A

United States Patent [19]

Bernhardt et al.

[11] Patent Number: 5,318,231

[45] Date of Patent: Jun. 7, 1994

[54] ROTARY SHREDDING CUTTERS

[75] Inventors: C. Theodore Bernhardt, Pittsburg, Kans.; Norman J. Emanuel, 1300 Moreland Ave., Baltimore, Md. 21216

[73] Assignee: Norman J. Emanuel, Baltimore, Md.

[21] Appl. No.: 963,638

[22] Filed: Oct. 20, 1992

[51] Int. Cl.[5] ..... B02C 4/08

[52] U.S. Cl. ..... 241/236; 241/295; 241/297; 241/300

[58] Field of Search ..... 241/236, 298, 300, 295, 241/297

[56] References Cited

U.S. PATENT DOCUMENTS

| | | | |
|---|---|---|---|
| 673,768 | 5/1901 | Fleming | 241/236 |
| 1,477,502 | 12/1923 | Killick . | |
| 2,986,347 | 5/1961 | Stevenson | 241/191 |
| 3,089,409 | 5/1963 | Tretheway et al. | 241/236 |
| 3,415,148 | 12/1968 | O'Brien | 83/302 |
| 3,991,944 | 11/1976 | Baikoff | 241/36 |
| 4,241,882 | 12/1980 | Baikoff | 241/236 |
| 4,374,573 | 2/1983 | Rouse et al. | 241/101 |
| 4,560,112 | 12/1985 | Rouse et al. | 241/236 |
| 4,607,800 | 8/1986 | Barclay | 241/159 |
| 4,688,731 | 8/1987 | Hunt et al. | 241/191 |
| 4,854,508 | 8/1989 | Dicky | 241/236 |
| 4,901,929 | 2/1990 | Barclay | 241/236 |
| 5,152,469 | 10/1992 | Dicky | 241/236 |

*Primary Examiner*—Mark Rosenbaum
*Assistant Examiner*—John M. Husar
*Attorney, Agent, or Firm*—Hugh Adam Kirk

[57] ABSTRACT

The disclosure concerns a peripherally-toothed cutting wheel for parallel series of intermeshed cutting wheels, such as employed for the shredding of tires. Each cutting wheel comprises three congruent disks axially bolted together in which the two outer disks have hardened rectangular teeth radially bolted thereon. The inner sides of these teeth abut the opposite surfaces of the intermediate or third spacer disk peripherally congruent with the two outer teeth-mounting disks. Each rectangular tooth comprises a block of hardened material, such as steel, and may be backed up by a second congruent rectangular block providing an outer wearing surface in addition to the outer side surface of the tooth itself.

6 Claims, 3 Drawing Sheets

ROTARY SHREDDING CUTTERS

BACKGROUND OF THE INVENTION

Shredders comprising parallel intermeshing, rotating, toothed cutting wheels with replaceable teeth are well known, including even series of cutting wheels with spacer disks between them to prevent shredded material from jamming in these spaces. Furthermore, cutting wheels with additional abrading-resisting surfaces on the outer sides of each wheel are also known. However, all of such known cutting wheels with teeth radially bolted thereto soon have these teeth wobble and/or shear the bolts that radially hold the teeth to the periphery of their toothed wheels.

SUMMARY OF THE INVENTION

Generally speaking, the cutting wheels of this invention comprise three congruent peripherally-toothed disks, the outer two disks of which have hardened rectangular block teeth radially bolted thereto and abutting on their inner sides against the center spacer toothed disk. Thus, each cutting wheel comprises an assembly of three disks, the outer two of which contain radially bolted teeth and the center spacer disk is congruent with the outer periphery of the toothed disks. This abutment of bolted-on block teeth against the intermediate spacer disk restricts the shear on the bolts that hold the teeth, as well as to increase the life of the teeth which can be removed and turned around to use their other sides as a cutting edge, thus at least doubling the life of the teeth on each cutting wheel assembly.

If desired, each of the rectangular teeth can be backed up radially inwardly with a congruent block in which only the outer side thereof acts as an extended wear surface under the outer side of the block cutting tooth. Both of which block-toothed parts may be bolted radially by the same plurality of bolts. In smaller disk wheels there is only room for two bolts; however, larger diameter cutting disks or wheels have room for at least three bolts for fastening the block teeth to the periphery of the outer pair of toothed cutting disks.

These three disks are preferably bolted together at a plurality of equally circumferentially spaced locations between their central axes and their peripheries, which bolts are countersunk so as not to interfere with their intermeshing or clog the material being shredded. Furthermore, these disks preferably have a noncircular central aperture to insure their keying to the shaft upon which they are mounted.

The two parallel shafts, on each of which an intermeshing series of these disks are mounted, are driven in the opposite direction toward each other. The cutting wheels are so located along these parallel shafts so that the peripheries of adjacent cutting wheels intermesh or overlap to provide a cutting and shearing action between adjacent teeth for cutting and tearing the articles to be shredded. A powerful motor, usually electric, is connected to a gear reduction box for driving the two parallel axles of intermeshing cutting wheels in opposite directions through a pair of intermeshing gears outside the shredding chamber containing the cutting wheels.

OBJECTS AND ADVANTAGES

It is an object of this invention to produce a simple, efficient, effective, and economical shredder cutting wheel with replaceable cutting teeth without having to replace the whole wheel when only its toothed periphery receives the most wear.

Another object is to provide a cutting wheel having pairs of axially congruent cutting teeth mounted to reduce shear on their radially extending mounting bolts.

Another object is to provide a cutting wheel with removable rectangular teeth which wear on one side only and can be reversed for doubling the length of their life.

Still another object is to reduce the fatigue of bolts employed for mounting removable rectangular teeth on cutting wheels.

Still another object is to prevent wobble and rocking of separately mounted rectangular teeth on the periphery of toothed cutting wheels.

BRIEF DESCRIPTION OF THE VIEWS

The above mentioned and other features, objects and advantages, and a manner of attaining them are described more specifically below by reference to embodiments of this invention shown in the accompanying drawings wherein.

Figure 4:
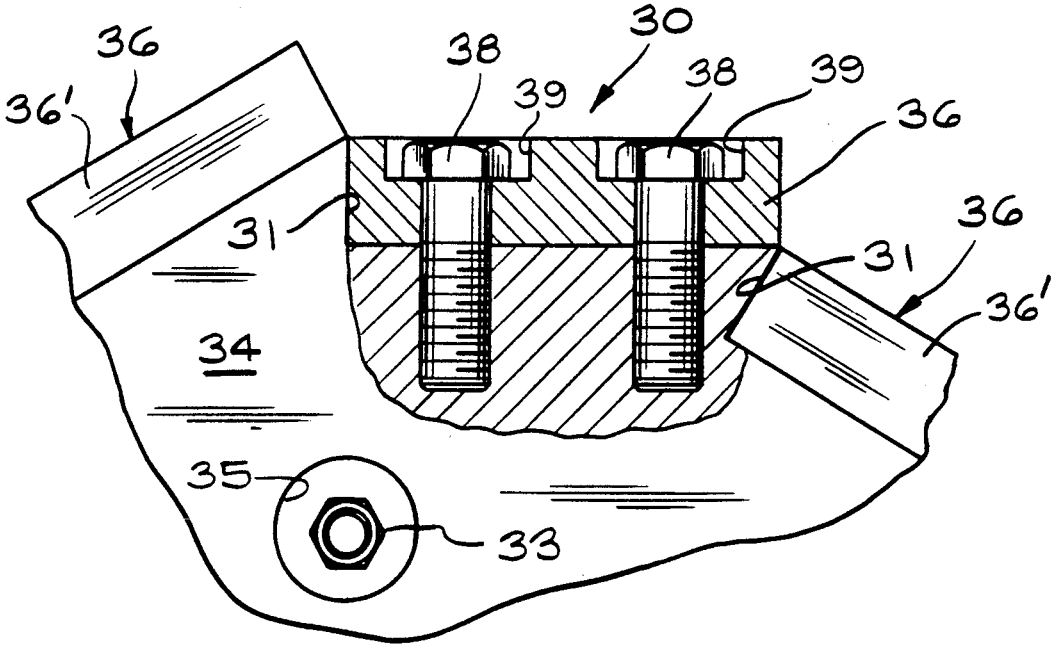
FIG. 4 is a sectional view taken along lines IV—IV of FIG. 3 showing the countersunk radial bolts for mounting the block cutting tooth to a toothed cutting disk.
Figure 5:
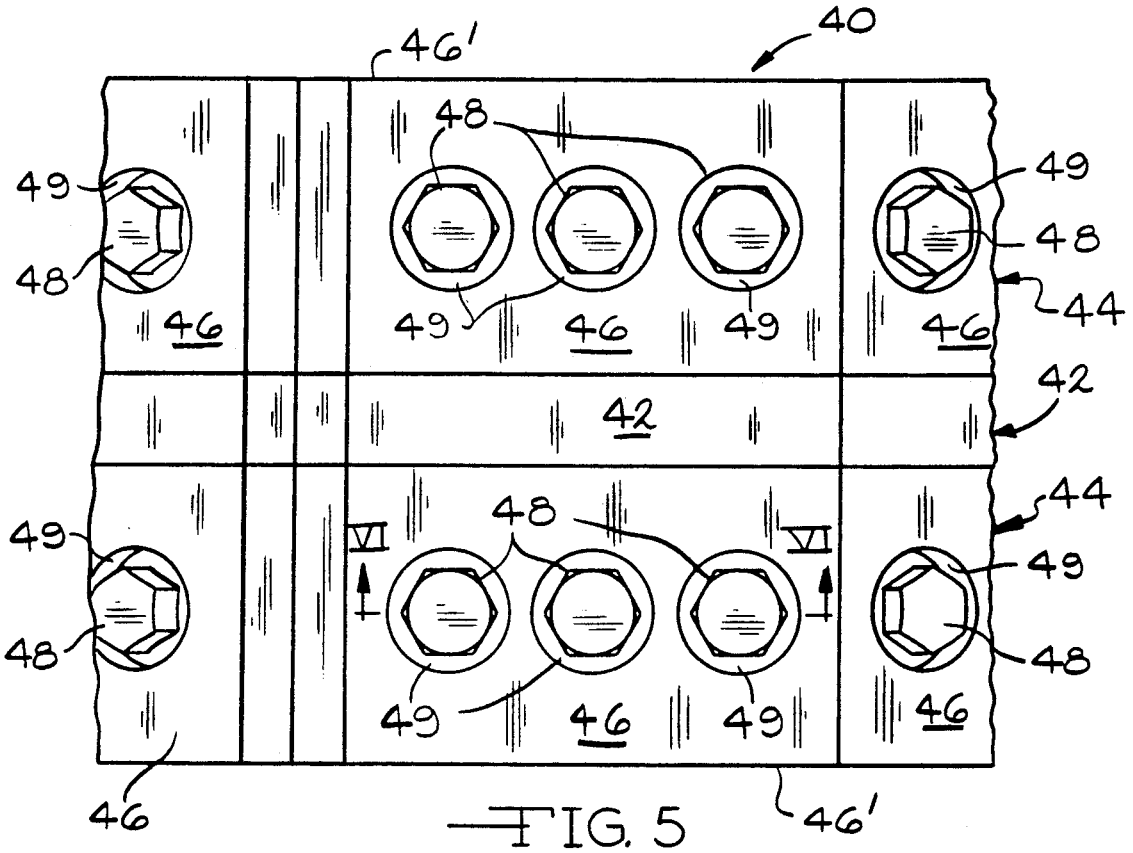
Figure 6:
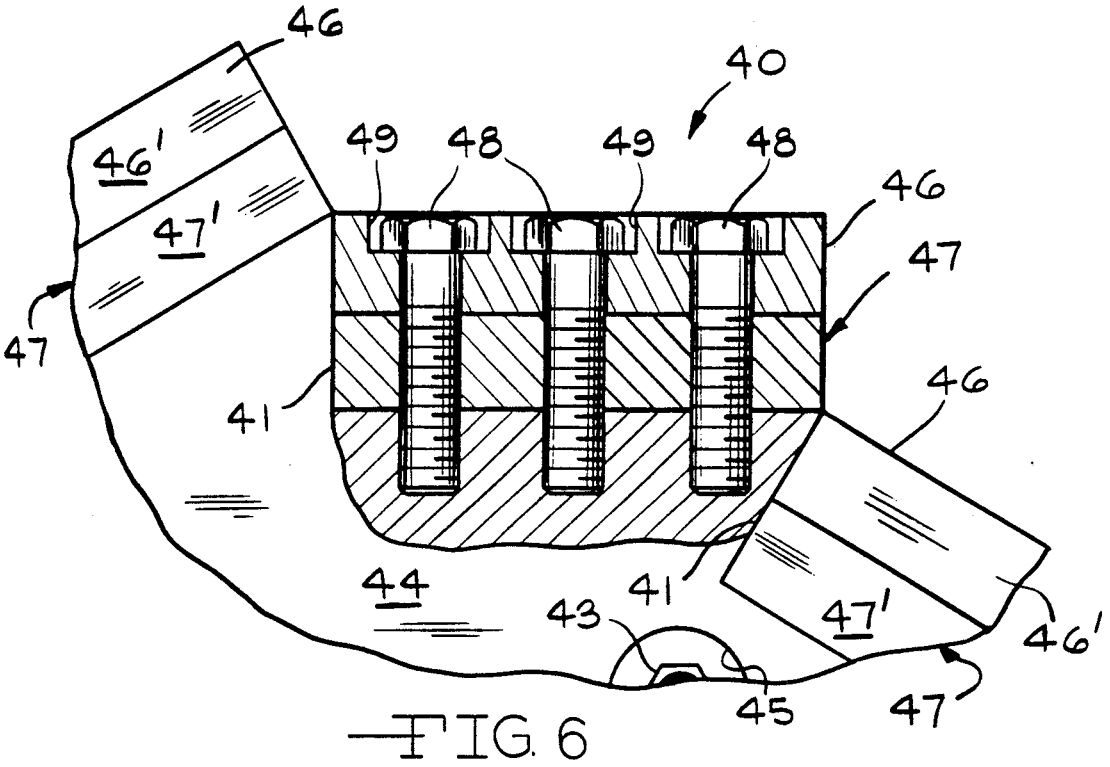

FIG. 5 is a view similar to FIG. 3 of another embodiment of this invention but of a larger diameter cutting wheel having three bolts for bolting the teeth to the pair of cutting disks on each side of a spacer disk forming the cutting wheel assembly of the invention; and FIG. 6 is a view similar to FIG. 4 of a vertical section along line VI—VI of FIG. 5, which also shows each block tooth having bolted below it an outer side wear rectangular block.

DETAILED DESCRIPTION OF THE PREFERRED EMBODIMENTS

Figure 1:
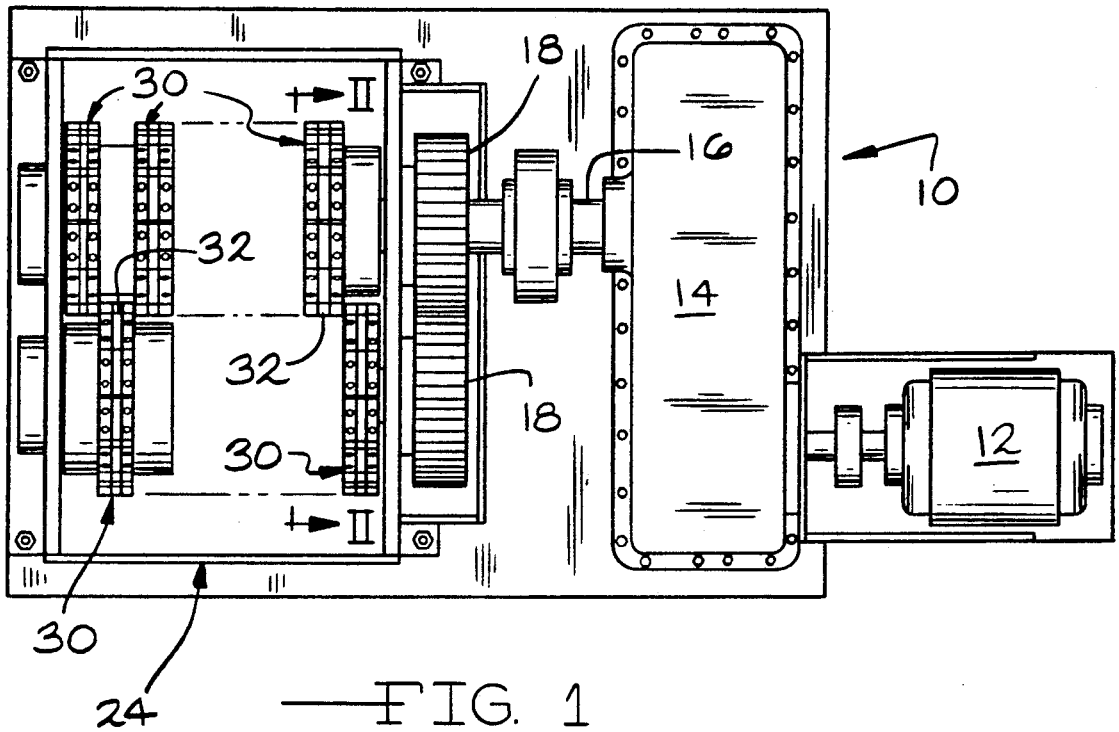
FIG. 1 is a plan view of a tire shredding machine incorporating the cutting wheels of this invention.
Figure 2:
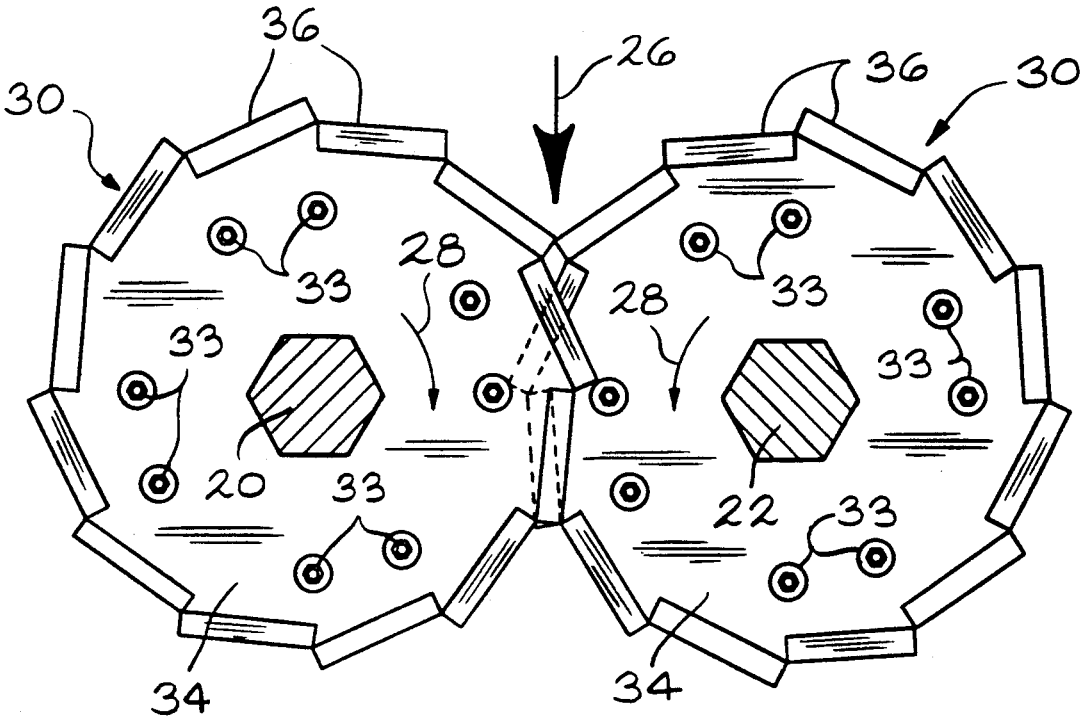
FIG. 2 is an enlarged view taken along lines II—II of FIG. 1 showing two cutting wheels with overlapping peripheries and rectangular block teeth attached to their peripheries.

As an example of a shredder which can use the cutting wheels of this invention, there is shown in FIG. 1 a tire shredding-type mechanism 10 driven by a powerful electric motor 12 which through a reduction gear mechanism 14 and output shaft 16 drives an intermeshing pair of gears 18 on parallel hexagonal shafts 20 and 22 (see FIG. 2). Upon these oppositely rotating shafts 20 and 22 are mounted two series of separate composite cutting wheel assemblies 30 of this invention. These cutting wheels 30 have their outer peripheries overlap each other as shown in FIG. 2 to provide the necessary tearing and shearing action of the parts that are to be shredded. These parallel series of cutting wheels 30 are mounted in the shredding compartment 24 of the shredder 10, wherein the articles to be shredded are fed down onto the two parallel series of cutting wheels in the direction of the arrow 26. Then the articles to be shredded are drawn into and between the two rows of cutting wheels 30 by their opposite rotation indicated by the arrows 28 on the wheels 30 in FIG. 2.

Figure 3:
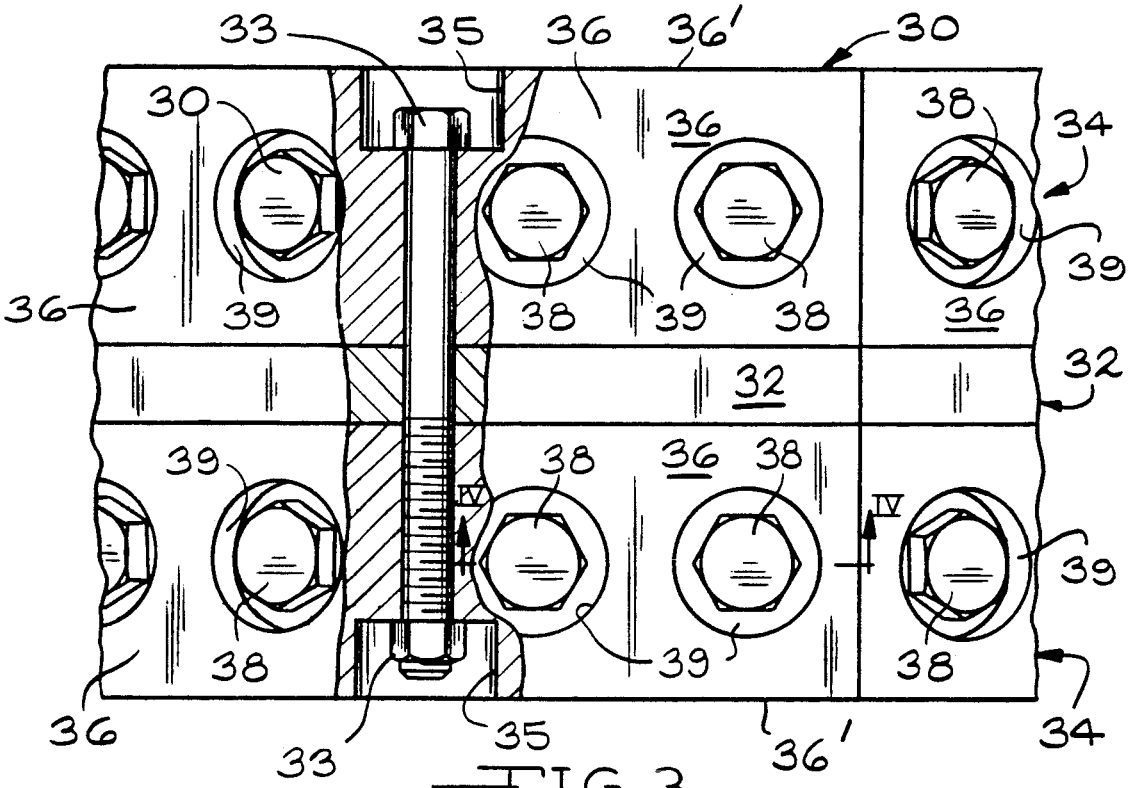
FIG. 3 is an enlarged view looking radially downwardly on one of the cutting wheels shown in FIGS. 1 and 2, with parts broken away, and showing the bolts for mounting the block teeth to the outer two cutting disks of a cutting wheel assembly and their intermediate spacing disk, and a bolt means for holding the disks together.

One of the most important features of this invention are the spacer disks 32 and 42 shown in FIGS. 3 and 5, respectively, which disks 32 and 42 have the same peripheral contour and are congruent with the two parallel cutting disks 34 and 44 of the cutting wheels 30 and 40. Thus, identical pairs of the cutting disks 34 and 44 sandwich the spacer disks 32 and 42, respectively, which sandwiches are held together by a plurality of equally arcuately spaced bolts 33 and 43 countersunk at 35 and 45 in the outer surfaces of the two cutting disks 34 and 44 (see FIG. 2).

Each pair of the cutting disks 34 and 44 are toothed or notched at 31 and 41 to fit each rectangular block tooth 36 and 46 that is radially bolted thereto. Each rectangular block tooth 36 and 46 abuts along its inner side against the spacer disk 32 and 42. Also each tooth block 36 and 46 is reversible and replaceable and is made of hardened metal such as steel.

Since the cutting wheels 30 and 40 are of different diameter, namely wheel 30 being smaller than that of wheel 40, only two bolts 38 are employed for radially anchoring each tooth 36 to the disk 34. The heads of these bolts are countersunk at 39 into the outer surface of the cutting teeth 36 (see FIG. 4). On the other hand, the larger wheel shown in the embodiment of FIGS. 5 and 6, has a sufficiently large block tooth 46 to permit three bolts 48 countersunk at 49 in its surface for removably holding the cutting teeth in place as well as their under tooth rectangular block 47 on each notch 41 of the cutting disk 44.

In FIGS. 5 and 6 the rectangular cutting teeth 46 may be assembled on top of an additional side face rectangular wear block 47, so that its outer visible 47' surface shown in FIG. 6 acts as an additional wearing surface for the overlapping or intermeshing of the two cutting wheels as shown in FIG. 2.

During the operation of the cutting wheels 30 or 40, only the outer edge or side 36' or 46' of the teeth 36 or 46 get any wear, since the opposite side of each of these teeth abuts against the spacer 32 or 42, respectively. This preserves that inner other side and its surface for further use when the outer surfaces 36' or 46' become too worn. Then the teeth can be unbolted and reversed in position so that the opposite surface of tooth 36 or 46 can be used, doubling the wear which each tooth can take. Furthermore, the added outer surface 47' of the added block 47 in FIG. 6 also increases the wear resistance of the cutting wheel 44. Thus the presence of the spacers 32 and 42 between the teeth, together with the plurality of bolts 38 and 48 which anchor the teeth, resist axial shear of the bolts 38 and 48 as well as preventing the wobble and rocking of the teeth 36 and 46. It is the composite cutting wheels 30 and 40, each comprising two cutting teethed disks 34 and 44 bolted 33 or 43 together with an intermediate spacer disk 32 and 42, that increases the wear and life of the cutting wheels of this invention.

It is to be understood that the double-toothed blocks shown in FIG. 6 may also be applied to the smaller wheel shown in FIGS. 1 through 4 without departing from the scope of this invention, and similarly teeth 46 without their wear blocks 47 may be provided in the embodiment shown in FIGS. 5 and 6.

While there is described above the principles of this invention in connection with specific apparatus, it is to be clearly understood that the description is made only by way of example and not as a limitation to the scope of this invention.

What is claimed is:

1. A shredder comprising at least one axial series of cutting wheels, each cutting wheel comprising a pair of axially congruent toothed cutting disks with a peripherally congruent toothed spacer between said disks, axially extending bolts fastening said pair of disks and spacer together to form said wheel, each said disk having a plurality of teeth around the periphery of each disk, and radially extending bolts fastening said teeth to each disk.

2. A shredder according to claim 1 comprising a pair of parallel intermeshing series of cutting wheels.

3. A shredder according to claim 1 wherein a plurality of radially extending bolts attach each of said teeth to said disks.

4. A shredder according to claim 1 wherein each of said teeth comprises a rectangular-shaped block.

5. A shredder according to claim 1 wherein each of said teeth has congruent wear blocks bolted between said teeth and said disk.

6. A tire shredding intermeshing series of rotary cutting wheels, each wheel comprising an outer pair of peripherally congruent tooth-mounting disks and a peripherally congruent intermediate toothed spacer, a plurality of axially extending bolt means for rigidly fastening said toothed mounting disks and spacer together as an integral cutting wheel, a plurality of rectangular cutting teeth extending around each disk, and radially extending bolt means for removably anchoring said teeth to each said disk, said teeth abutting against said spacer.

* * * * *

UNITED STATES PATENT AND TRADEMARK OFFICE

CERTIFICATE OF CORRECTION

PATENT NO. : 5,318,231
DATED : June 7, 1994
INVENTOR(S) : Bernhardt et al

It is certified that error appears in the above-indentified patent and that said Letters Patent is hereby corrected as shown below:

On the title page, item [75], the name and address "C. Theodore Bernhardt, Pittsburg, Kans." should be omitted.

Signed and Sealed this
Seventeenth Day of January, 1995

*Attest:*

*Attesting Officer*

BRUCE LEHMAN

*Commissioner of Patents and Trademarks*